US005772109A

United States Patent [19]

Phipps

[11] Patent Number: 5,772,109

[45] Date of Patent: Jun. 30, 1998

[54] CARTON HANDLE ASSEMBLY

[75] Inventor: H. Scott Phipps, Easley, S.C.

[73] Assignee: Package Supply & Equipment Co., Inc., Greenville, S.C.

[21] Appl. No.: 704,934

[22] Filed: Aug. 30, 1996

[51] Int. Cl.[6] ..... B65D 77/00

[52] U.S. Cl. ..... 229/117.23; 294/33; 294/27.1

[58] Field of Search ..... 294/27.1, 33, 159; 220/23.4, 737, 759; 229/117.19, 117.23

[56] References Cited

U.S. PATENT DOCUMENTS

| | | | |
|---|---|---|---|
| 1,455,020 | 5/1923 | Collins . | |
| 1,918,486 | 7/1933 | Onos . | |
| 2,514,858 | 7/1950 | Gray . | |
| 2,801,129 | 7/1957 | Gegan . | |
| 2,856,069 | 10/1958 | Felber . | |
| 2,860,000 | 11/1958 | Marcheski . | |
| 3,080,965 | 3/1963 | Kuchenbecker . | |
| 3,251,622 | 5/1966 | Miller . | |
| 3,297,350 | 1/1967 | Hidding . | |
| 3,301,586 | 1/1967 | Lisiecki | 294/33 |
| 3,652,115 | 3/1972 | Grow | 294/27.1 |
| 3,829,143 | 8/1974 | Bird . | |
| 3,900,103 | 8/1975 | Day . | |
| 4,033,489 | 7/1977 | Fowler | 294/159 |
| 4,776,622 | 10/1988 | Ross . | |
| 4,911,289 | 3/1990 | Bird . | |
| 5,346,271 | 9/1994 | Erickson . | |
| 5,473,796 | 12/1995 | Fusillo | 24/338 X |

*Primary Examiner*—Joseph M. Moy
*Attorney, Agent, or Firm*—Dority & Manning, P.A.

[57] ABSTRACT

A handle assembly is provided for use with cartons having vertical tabs extending above the carton. At least one elongated receiver structure has a longitudinal slot defined therethrough for receipt of the vertical tab. The longitudinal slot defines a plurality of side teeth extending into the slot transversely to the longitudinal axis thereof such that the side teeth lockingly engage the tab when the carton is suspended from the elongated receiver structure. A handle is attached to at least one elongated receiver structure. The handle is configured to be gripped by hand and to convey an upward force to at least one elongated receiver structure to in turn lift a carton or cartons engaged by the plural teeth.

20 Claims, 3 Drawing Sheets

Fig. 4
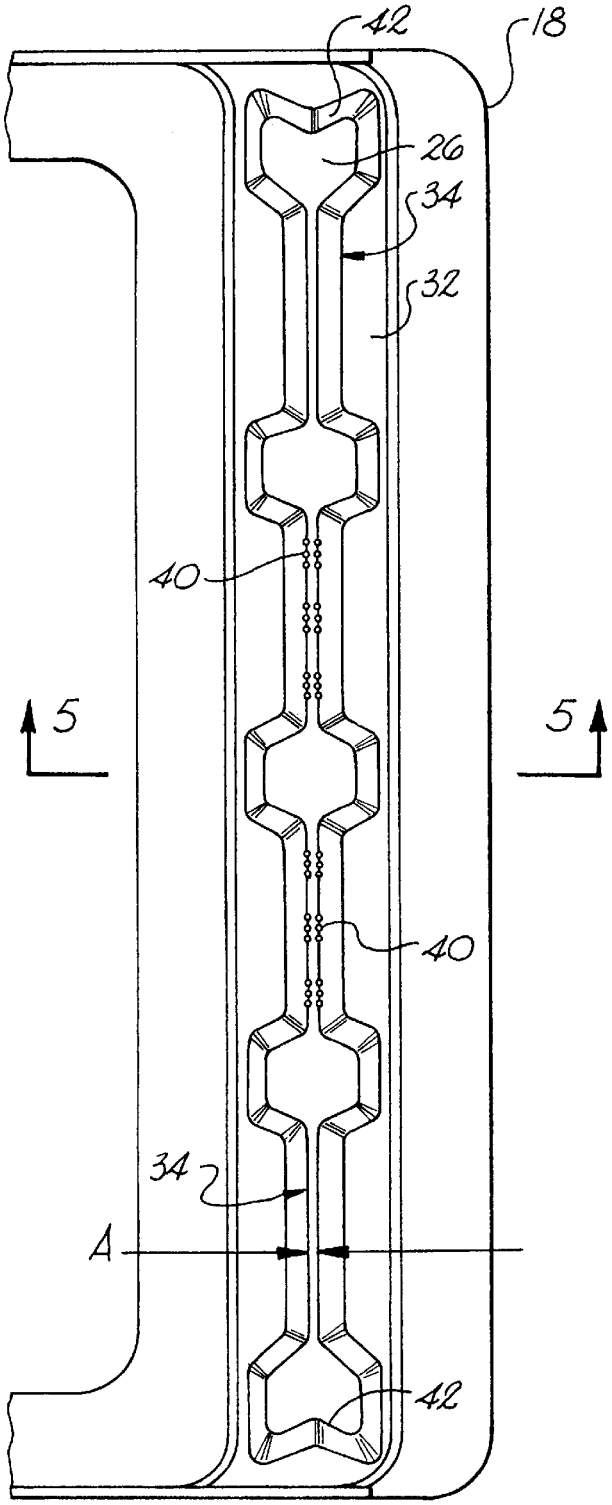
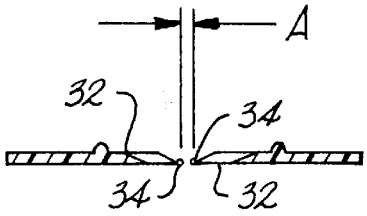
Fig. 5
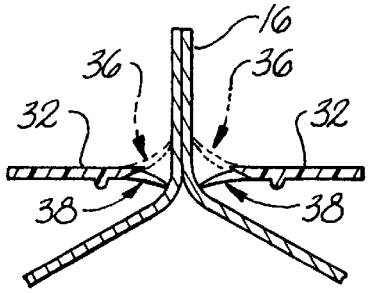
Fig. 6
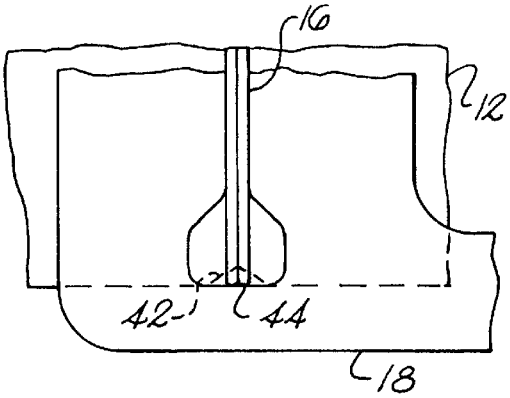
Fig. 7

CARTON HANDLE ASSEMBLY

BACKGROUND OF THE INVENTION

The present invention relates to a handle assembly for use in securing and transporting cartons. More particularly, the invention relates to improvements in a handle assembly for use with cartons having vertical tabs extending above the carton.

Presently, carton containers are used in packaging a variety of materials, for example liquids such as milk, juice or oil. Many of these cartons, particularly those having gabled tops, are closed at the tops with vertical tabs.

Although such cartons may be efficiently packed, their combined bulk and weight often make them difficult to pick up, particularly from above. Accordingly, devices that are easily gripped by the human hand have been developed that are capable of securing one or more such cartons. In particular, devices are known which secure the carton about the vertical tab. Attachment to the vertical tab is preferable in some circumstances because the tab is a readily accessible carton feature.

However, because the tab extends upward in the vertical plane, it is difficult to adequately grip the tab so that the carton with its load may be lifted upward. Accordingly, prior art handle devices that are applied to the tab, such as is disclosed in U.S. Pat. No. 3,900,103, typically apply the lifting force so as to encourage the carton to tilt from a vertical orientation, thereby locking the tab between vertically offset horizontal forces.

When multiple cartons are carried in such devices, however, the cartons tend to splay outward to some degree from the carrier. This may make carrying the cartons in the carrier clumsy and may make placement of the cartons in a confined space, for example in a crate or on a conveyor belt container, difficult.

Furthermore, devices are known, such as disclosed in U.S. Pat. No. 2,860,000, that grip the vertical tab by a clip device. Such devices tend, however, to be clumsy in use and in application to the cartons.

Based on the foregoing, it can be seen that a need exists for a carton carrier that can effectively engage a vertical carton tab.

SUMMARY OF THE INVENTION

The present invention recognizes and addresses the foregoing disadvantages, and others, of prior art construction and methods.

Accordingly, it is an object of the present invention to provide an improved carton carrier for cartons having vertical tabs.

More particularly, it is an object of the present invention to provide a carton carrier capable of effectively engaging a vertical carton tab while the carton is being lifted and/or carried.

It is another object of the present invention to provide a carton carrier for simultaneously lifting two cartons.

Some of these objects are achieved by a handle assembly for use with cartons having vertical tabs extending above the carton. The assembly includes at least one elongated receiver structure having a longitudinal slot defined therethrough for receipt of the vertical tab. The receiver structure defines a plurality of side teeth extending into the slot transversely to the longitudinal axis thereof such that the side teeth lockingly engage the tab when the carton is suspended from the receiver structure.

A handle is attached to the at least one elongated receiver structure. The handle is configured to be gripped by hand and to convey the upward force to the at least one elongated receiver structure.

In one exemplary preferred embodiment of the present invention, the assembly includes two such elongated receiver structures disposed parallel to each other. The elongated receiver structures are attached by two struts attached to corresponding ends of the elongated receiver structures such that the struts are parallel to one another. Thus, the struts and the receiver structures form a rectangular frame, the slots of the receiver structures being disposed at opposite parallel sides of the frame.

Preferably, the assembly is configured such that the cartons do not splay outward when lifted. Thus, for example, each strut may be rigid in a plane that is perpendicular to the longitudinal axis of the slots. That is, when the assembly is applied to lift a pair of cartons, the struts do not bend, and the cartons are maintained in a vertical orientation as they are lifted upwardly by the assembly.

Those of ordinary skill in this art should understand that various configurations and constructions of the struts are possible. For example, the struts may be rod-like structures made of a rigid material. Furthermore, the struts made from a hard plastic material that is resilient yet constructed in a manner that provides rigidity in the necessary plane. This may be particularly preferable if the entire assembly is constructed from a hard plastic material. For example, a flange may extend from each strut in a perpendicular plane at least partially between the receiver structures, thereby preventing bending of each strut in the plane. Thus, "rigid" as used herein means that the strut will not bend in a particular direction under the load of the cartons supported by the assembly. Of course, if the assembly is constructed from a resilient material, it is possible the deformation of the strut could occur upon application of a sufficient force. The strut, however, need only be constructed to effectively bear the load of the full cartons without bending.

Additionally, the assembly may be provided with one or a plurality of struts. For example, a strut may comprise a single piece entirely connecting the receiver structures such that the strut and the receiver structures appear as a single unitary structure having the longitudinal slots defined at the edges thereof.

Similarly, the handle may be constructed in a variety of suitable fashions and may be attached to the receiver structures in a variety of manners, including via the struts. For example, the strut itself could define the handle if the strut is configured to be gripped by hand.

Preferably, the side teeth are grouped in pairs. The teeth in each pair of side teeth are disposed opposite one another across the slot such that the opposing free edges of the teeth in each pair are separated by a distance less than the width of the tab. Accordingly, when the tab is inserted into the slot, the teeth apply pressure to the side of, and thereby lockingly engage, the tab. Preferably, the receiver structures are constructed from a resilient hard plastic material, such as high density polyethylene, which permits the elements of receiver structure on either side of the structure's slot to bend with the tab as the tab is inserted through the slot but which does not permit compression of the teeth. The insertion of the tab into the slot thus displaces, but does not compress, the teeth. The teeth are urged back toward the center of the slot and are therefore forced against the sides of the tab.

In particular, one or both of the sets of teeth on either slot side will typically be displaced in an upward direction upon insertion of the tab. Thus, when the assembly is lifted, the downward force exerted on the teeth, and particularly on the upward facing teeth, by the fully loaded carton causes the teeth to lockingly engage the tab.

In a preferred embodiment, each longitudinal slot defines a pair of opposing end teeth disposed on opposite longitudinal ends of the slot and extending into the slot. When the cartons are lifted by the assembly, these end teeth engage the ends of the carton tabs to help secure the cartons by the tabs.

As indicated above, one object of the present invention is to effectively secure a plurality of cartons, having vertical tabs, by their vertical tabs while maintaining the cartons in a vertical position during lifting. Accordingly, one preferred embodiment of the present invention includes a pair of parallel elongated receiver structures. Each elongated receiver structure has a longitudinal slot defined therethrough for receipt of a vertical tab of a carton. Each longitudinal slot is configured to lockingly engage the tab when the carton is vertically suspended from the elongated receiver structure by its tab. At least one strut is attached to the elongated receiver structures. At least one of the struts is rigid in a plane that is perpendicular to the longitudinal axis of the slots. A handle is attached to the elongated receiver structures and is configured to be gripped by hand and to convey an upward force to the receiver structures.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which:

FIG. 4 is a partial and enlarged bottom view of a handle assembly in accordance with the present invention illustrating one elongated receiver structure;

FIG. 5 is a partial cross-sectional view of the elongated receiver structure, taken along the sectional Line 5—5 in FIG. 4;

FIG. 6 is a partial cross-sectional view of an elongated receiver structure of a handle assembly in accordance with the present invention as applied to a vertical tab on a carton, taken along the sectional line 6—6 in FIG. 1; and FIG. 7 is a partial top view of a handle assembly in accordance with the present invention illustrating the operation of an end tooth, and as seen from view line 7—7 in FIG. 1.

Figure 1:
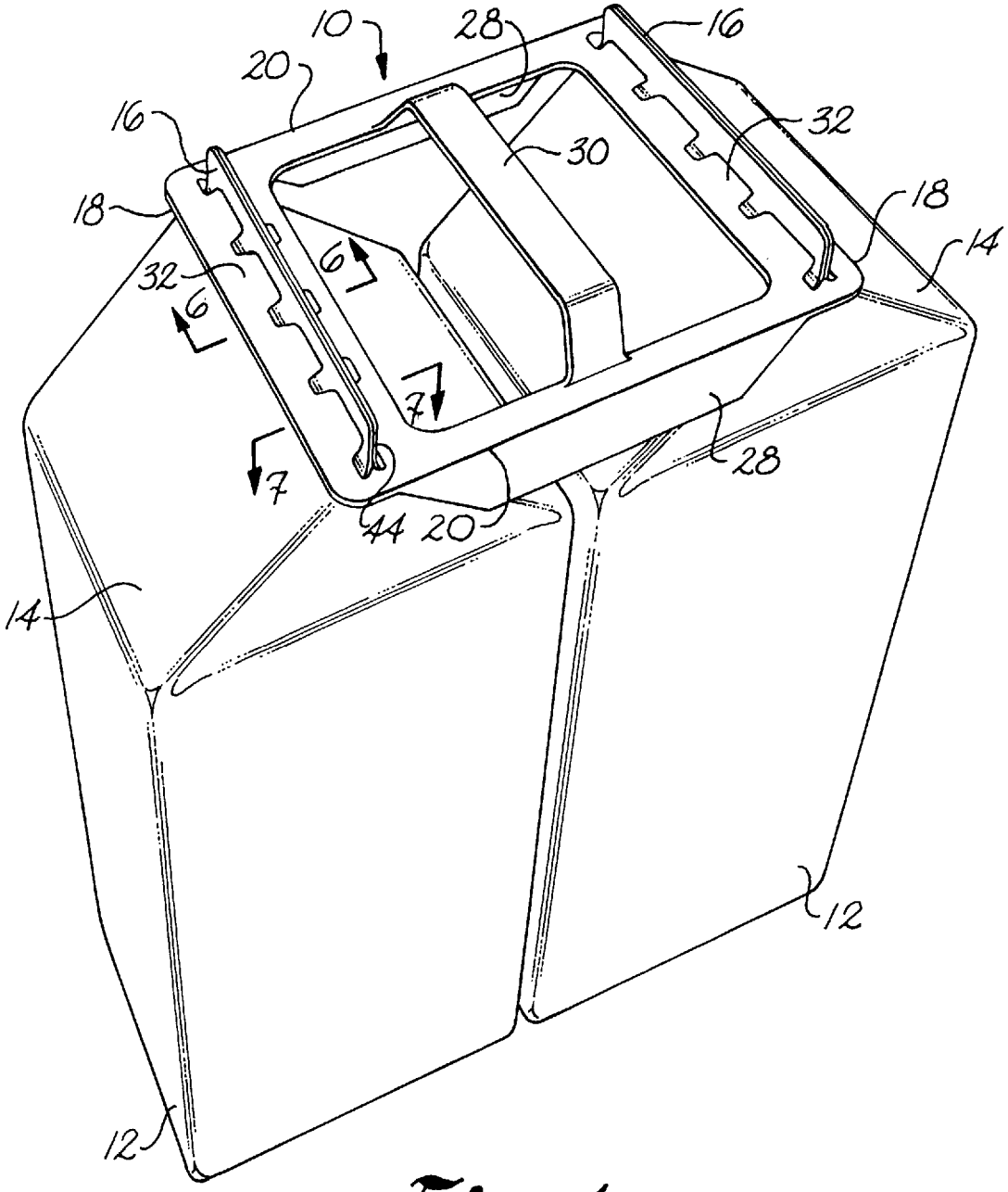
FIG. 1 is a perspective view of a handle assembly according to the present invention applied to a pair of cartons having vertical edges or tabs at their tops.

Repeat use of reference characters in the present specification and drawings is intended to represent same or analogous features or elements of the invention.

DETAILED DESCRIPTION OF PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is concerned with an improved handle assembly for use with cartons having vertical tabs extending above the carton. Accordingly, FIG. 1 depicts a presently preferred embodiment of a handle assembly 10 securing cartons 12. Each carton 12 has a gabled top 14 fastened at a vertical tab 16.

Figure 2:
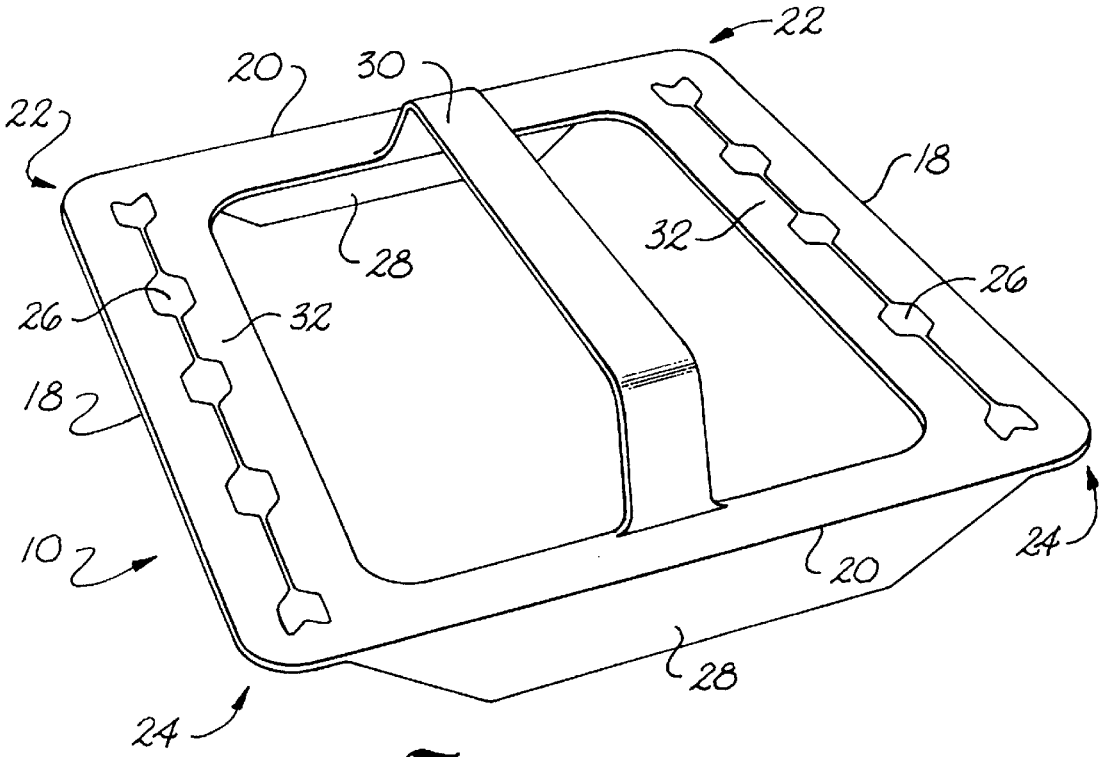
FIG. 2 is a top perspective view of a handle assembly in accordance with the present invention.
Figure 3:
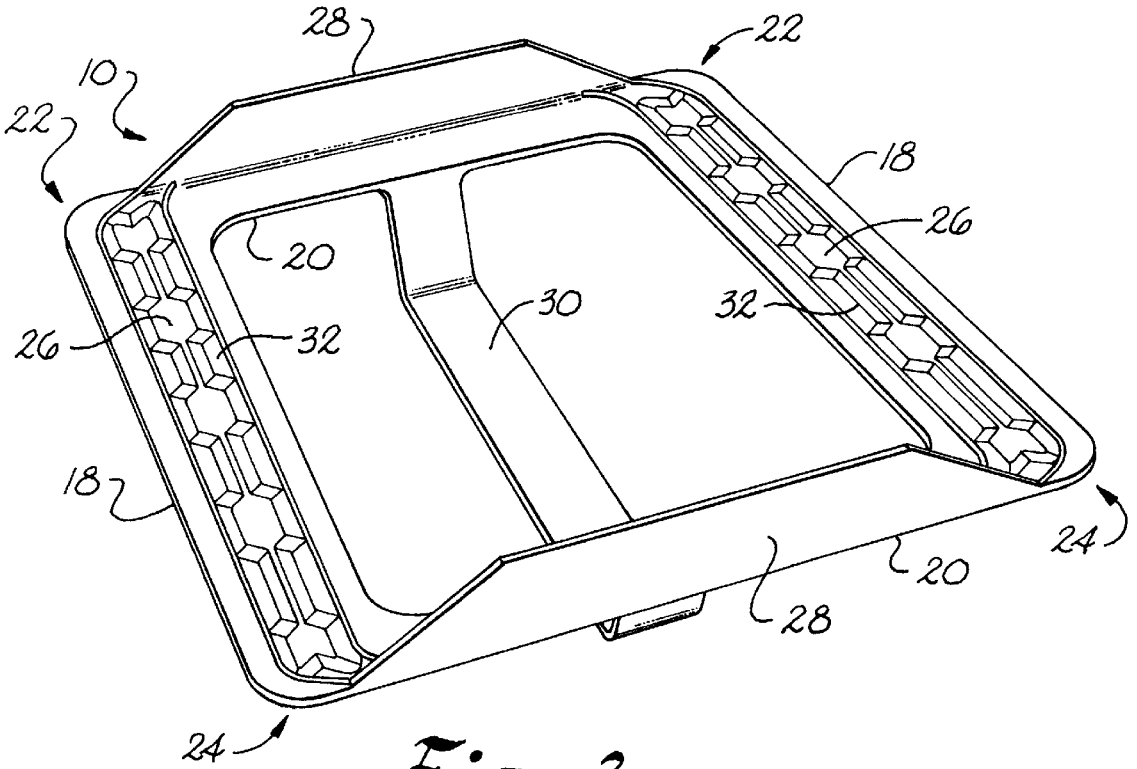
FIG. 3 is a bottom perspective view of a handle assembly according to the present invention.

Referring to FIGS. 2 and 3, handle assembly 10 includes a pair of parallel elongated receiver structures 18 connected by two struts 20 extending between the receiver structures 18. Struts 20 are attached to corresponding ends 22 and 24 of receiver structures 18, thereby maintaining parallel orientation of struts 20.

Struts 20 are rigid in a plane perpendicular to the longitudinal axis of slots 26 defined by receiver structures 18. As is discussed above in the Summary of the Invention, the rigidity of the struts may be attributable to, for example, the material composition of the struts and/or to their mechanical construction. For example, in the embodiment illustrated in the figures, the handle assembly is constructed out of a resilient hard plastic such as high density polyethylene. Accordingly, each strut 20 includes a support flange 28 extending between receiver structures 18 in a plane perpendicular to the longitudinal axes of slots 26. Flanges 28 prevent bending of struts 20 in the perpendicular planes even though the assembly 10 is constructed from a resilient material and even though the struts 20 may bend in other directions. Those of ordinary skill in this art should understand that various suitable constructions are possible which would impart rigidity to flanges 20. All such suitable constructions are understood to be within the scope and spirit of the present invention.

The rigidity of struts 20 generally maintain the parallel relationship of elongated receiver structures 18 when cartons are received thereby. For example, referring to FIG. 1, cartons 12 are shown attached to carrier 10. Carrier 10 would be lifted, for example by hand (not shown for purposes of clarity), at a handle 30 extending between struts 20. Thus, when assembly 10 is lifted by handle 30, rigid struts 20 maintain the generally parallel orientation of receiver structures 18 with respect to each other. This, in turn, generally maintains the vertical and parallel orientation of loaded cartons 12. That is, struts 20 do not bend upon application of the load from the cartons. Cartons 12 thus remain in a vertical orientation and do not splay outwards upon lifting of the handle assembly.

Because the cartons are maintained in a vertical position when lifted and carried by the handle assembly 10, a vertical downward force is exerted upon tabs 16 tending to pull the tabs downward from assembly 10. However, receiver structures 18 are configured to lockingly engage the tabs while the cartons are vertically suspended from assembly 10. In the preferred embodiment illustrated in the figures, each receiver structure 18 includes a plurality of side teeth 32 extending into slot 26 (illustrated without the insertion of vertical tabs in FIGS. 2 and 3) transversely to the longitudinal axis thereof. Side teeth 32 lockingly engage their respective tab 16 when the carton is suspended from its receiver structure 18.

FIG. 4 provides a bottom view illustration of a receiver structure 18. Side teeth 32 are beveled to present an acute angled edge to the tab 16 (FIG. 1) when the tab is received by receiver structure 18. Free ends 34 of side teeth 32 are separated by a distance A (FIG. 5) that is less than the width of the tab 16 (FIG. 1). Accordingly, referring to FIG. 1, the insertion of tab 16 into slot 26 (FIGS. 2 through 4) causes side teeth 32 to deflect upwards. Side teeth 32 are constructed from a resilient hard plastic which does not, however, compress under the force exerted by the cartons 12. Thus, the upward facing teeth 32 are forced into a locking engagement with the tab 16 when a downward force (i.e. gravity) is applied to the tab by the loaded carton 12 when assembly 10 is lifted.

The displacement of side teeth 32 is illustrated (magnified) in cross-section in FIG. 6. After insertion of the tab 16, the side teeth 32 may be displaced upwardly as indicated in phantom at 36. It is possible, however, that one but not both of the teeth in a pair of opposing side teeth 32 will be turned upward. Moreover, it has been found that although various displacements of the side teeth 32 may occur, the side teeth are generally urged back toward the longitudinal axis of the slot 26 and thereby lockingly engage the tab 16.

When the cartons 12 held by assembly 10 are set to a rest position such that the downward force on side teeth 32 exerted by tab 16 is removed, the elongated receiver structure 18 (FIG. 1) may be removed by pulling upwards on the sides thereof. This may deflect the free ends of teeth 32 downwards, as indicated at 38 in FIG. 6, thereby permitting the removal of the tab 16 from the receiver structure.

It should be understood that the receiver structure may be configured in various suitable fashions to lockingly engage the tab 16 when the carton 12 is vertically suspended from the receiver structure. For example, referring to FIG. 4, two pair of opposing side teeth 32 define ridges 40 thereon to aid the side teeth 32 in engaging the tab 16. Ridges 40 on opposing side teeth 32 may be linearly offset so that they meet in an interlocking fashion. In such a construction, the opposing ridges may entirely bridge the distance A between the free ends. The ridges may be particularly preferable in the middle pairs of opposing side teeth.

Additionally, end teeth 42 may be disposed on opposite longitudinal ends of slot 26 to lockingly engage ends 44 (FIG. 7) of tab 16 when carton 12 is suspended from the receiver structure 18.

While preferred embodiments of the invention have been described above, it is to be understood that any and all equivalent realizations of the present invention are included within the spirit and scope thereof. For example, various suitable configurations of the receiver structure are possible to lockingly engage the vertical tab of the carton as it is vertically suspended from the receiver structure. Also, the assembly may be configured to carry a single carton, or various pluralities of cartons. Additionally, various constructions and configurations are possible to maintain the rigidity of struts attached to the receiver structures. Furthermore, a variety of structures for the assembly may be achieved. For example, the assembly may be constructed from a single continuous sheet of hard plastic having one or more slots defined therein for receipt of a vertical tab. The handle may be attached to the assembly in a variety of fashions and, for example, may be embodied by the struts if the struts are configured to be gripped by hand. Therefore, it is contemplated that any and all such embodiments are included in the present invention as may fall within the literal or equivalent scope of the appended claims.

What is claimed is:

1. A handle assembly for use with cartons having vertical tabs extending above the carton, said handle assembly comprising:

at least one elongated receiver structure having a longitudinal slot defined therethrough for receipt of the vertical tab, said receiver structure defining a plurality of side teeth extending into said slot transversely to the longitudinal axis thereof such that said side teeth lockingly engage the tab when the carton is suspended from said elongated receiver structure by its tab; and a handle attached to said at least one elongated receiver structure, said handle being configured to be gripped by hand and to convey an upward force to said at least one elongated receiver structure so that said receiver structure grips the vertical tab at said longitudinal slot to lift the carton.

2. The assembly as in claim 1, wherein said side teeth are grouped in pairs, the teeth in each of said pairs of side teeth being disposed opposite one another across said slot to engage the tab.

3. A handle assembly for use with cartons having vertical tabs extending above the carton, said handle assembly comprising:

at least one elongated receiver structure having a longitudinal slot defined therethrough for receipt of the vertical tab, said receiver structure defining a plurality of side teeth extending into said slot transversely to the longitudinal axis thereof and a pair of opposing end teeth disposed on opposite longitudinal ends of said slot and extending longitudinally into said slot such that said side teeth lockingly engage the tab, and such that said end teeth lockingly engage the ends of the tab, when the carton is suspended from said elongated receiver structure by its tab; and a handle attached to said at least one elongated receiver structure, said handle being configured to be gripped by hand and to convey an upward force to said at least one elongated receiver structure.

4. A handle assembly for use with cartons having vertical tabs extending above the carton, said handle assembly comprising:

two elongated receiver structures disposed parallel to each other, each having a longitudinal slot defined therethrough for receipt of a vertical tab and defining a plurality of side teeth extending into said slot transversely to the longitudinal axis thereof such that said side teeth lockingly engage the tab when the carton is suspended from said elongated receiver structure by its tab; and a handle attached to said at least one elongated receiver structure, said handle being configured to be gripped by hand and to convey an upward force to said at least one elongated receiver structure, wherein said two elongated receiver structures are connected by at least one strut extending between said elongated receiver structures, at least one said strut being rigid in a plane that is perpendicular to the longitudinal axes of said slots.

5. The assembly as in claim 4, wherein said handle is attached to said elongated receiver structures via at least one said strut.

6. The assembly as in claim 4, wherein at least one said rigid strut includes a support flange extending at least partially between said elongated receiver structures in said plane, thereby preventing bending of said strut in said plane.

7. The assembly as in claim 4, having two said rigid struts attached to corresponding ends of said elongated receiver structures such that said rigid struts are disposed parallel to one another and perpendicular to said elongated receiver structures.

8. The assembly as in claim 7, wherein said handle extends between said struts parallel to said elongated receiver structures.

9. A handle assembly for use with cartons having vertical tabs extending above the carton, said handle assembly comprising:

at least one elongated receiver structure having a longitudinal slot defined therethrough for receipt of the vertical tab, said receiver structure defining a plurality of side teeth extending into said slot transversely to the longitudinal axis thereof such that said side teeth lockingly engage the tab when the carton is suspended from said elongated receiver structure by its tab; and a handle attached to said at least one elongated receiver structure, said handle being configured to be gripped by hand and to convey an upward force to said at least one elongated receiver structure, wherein the teeth of at least one of said pairs of side teeth each defines a plurality of ridges on said free edges thereof.

10. A handle assembly for use with cartons having vertical tabs extending above the carton, said handle assembly comprising:

at least one elongated receiver structure having a longitudinal slot defined therethrough for receipt of the vertical tab, said receiver structure defining a plurality of side teeth extending into said slot transversely to the longitudinal axis thereof such that said side teeth lockingly engage the tab when the carton is suspended from said elongated receiver structure by its tab; and a handle attached to said at least one elongated receiver structure, said handle being configured to be gripped by hand and to convey an upward force to said at least one elongated receiver structure, wherein said side teeth are beveled to present an acute angled edge to the vertical tab when the tab is received by said at least one elongated receiver structure.

11. A handle assembly for use with cartons having vertical tabs extending above the carton, said handle assembly comprising:

a pair of parallel elongated receiver structures, each said elongated receiver structure having a longitudinal slot defined therethrough for receipt of a vertical tab of a carton and each said receiver structure defining a plurality of pairs of side teeth extending into said slot, the teeth in each of said pairs of side teeth being disposed opposite one another across said slot such that opposing free edges of said teeth in each said pair are separated by a distance less than the width of the tab to be received by said slot, such that said side teeth lockingly engage the tab when the carton is suspended from said elongated receiver structure by its tab;

at least one strut attached to said elongated receiver structures, at least one said strut being rigid in a plane that is perpendicular to the longitudinal axes of said slots; and a handle attached to said elongated receiver structures via at least one said strut, said handle being configured to be gripped by hand and to convey an upward force to said elongated receiver structures.

12. The assembly as in claim 11, including two said rigid struts attached to corresponding ends of said elongated receiver structures such that said rigid struts are disposed parallel to one another and perpendicular to said elongated receiver structures.

13. The assembly as in claim 12, wherein each said rigid strut includes a support flange extending at least partially between said elongated receiver structures in said plane, thereby preventing bending of said rigid strut in said plane.

14. The assembly as in claim 11, wherein each said receiver structure defines a pair of opposing end teeth disposed on opposite longitudinal ends of said slot and extending longitudinally into said slot such that said end teeth lockingly engage the ends of the tab when the carton is suspended from said elongated receiver structure by its tab.

15. The assembly as in claim 11, wherein the teeth of at least one of said pairs of side teeth on each of said elongated receiver structures each defines a plurality of ridges on said free edges thereof.

16. The assembly as in claim 11, wherein said side teeth are beveled to present an acute angled edge to the vertical tabs when the tabs are received by said elongated receiver structures.

17. A handle assembly for use with cartons having vertical tabs extending above the carton, said handle assembly comprising:

a pair of parallel elongated receiver structures, each said elongated receiver structure having a longitudinal slot defined therethrough for receipt of a vertical tab of a carton and each said longitudinal slot being configured to lockingly engage the tab when the carton is vertically suspended from said elongated receiver structure by its tab;

at least one strut attached to said elongated receiver structures, at least one said strut being rigid in a plane that is perpendicular to the longitudinal axes of said slots, whereby a pair of cartons may be vertically suspended from said elongated receiver structures while maintaining an aligned orientation with respect to each other; and a handle attached to said elongated receiver structures, said handle being configured to be gripped by hand and to convey an upward force to said elongated receiver structures.

18. The assembly as in claim 17, wherein at least one said strut includes a support flange extending at least partially between said elongated receiver structures in said plane, thereby preventing bending of said at least one strut in said plane.

19. A handle assembly for use with cartons having vertical tabs extending above the carton, said handle assembly comprising:

at least one elongated receiver structure having a longitudinal slot defined therethrough for receipt of the vertical tab, said receiver structure defining a pair of opposing end teeth disposed on opposite longitudinal ends of said slot and extending longitudinally into said slot such that said end teeth lockingly engage the ends of, and axially aligned with, the tab when the carton is suspended from said elongated receiver structure by its tab; and a handle attached to said at least one elongated receiver structure, said handle being configured to be gripped by hand and to convey an upward force to said at least one elongated receiver structure.

20. A handle assembly for use with cartons having vertical tabs extending above the carton, said handle assembly comprising:

two elongated receiver structures disposed parallel to each other, each having a longitudinal slot defined therethrough for receipt of a vertical tab and defining a pair of opposing end teeth disposed on opposite longitudinal ends of said slot and extending longitudinally into said slot such that said end teeth lockingly engage the ends of the tab when the carton is suspended from said elongated receiver structure by its tab; and a handle attached to said at least one elongated receiver structure, said handle being configured to be gripped by hand and to convey an upward force to said at least one elongated receiver structure, wherein said two receiver structures are connected to each other by at least one strut extending between said elongated receiver structures, at least one said strut being rigid in a plane that is perpendicular to the longitudinal axes of said slots.

* * * * *